US009195161B2

(12) United States Patent
Kurihara et al.

(10) Patent No.: US 9,195,161 B2
(45) Date of Patent: Nov. 24, 2015

(54) OPTICAL SCANNING APPARATUS AND IMAGE FORMING APPARATUS PROVIDED WITH THE SAME

(71) Applicant: KYOCERA Document Solutions Inc., Osaka (JP)

(72) Inventors: Takayuki Kurihara, Osaka (JP); Masato Onishi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/517,115

(22) Filed: Oct. 17, 2014

(65) Prior Publication Data

US 2015/0116436 A1 Apr. 30, 2015

(30) Foreign Application Priority Data

Oct. 30, 2013 (JP) ..... 2013-226072

(51) Int. Cl.

| | |
|---|---|
| ***B41J 15/14*** | (2006.01) |
| ***B41J 27/00*** | (2006.01) |
| ***G03G 15/043*** | (2006.01) |
| ***G03G 15/04*** | (2006.01) |

(52) U.S. Cl.
CPC ..... *G03G 15/043* (2013.01); *G03G 15/0409* (2013.01)

(58) Field of Classification Search
USPC ..... 347/230, 233, 241–245, 256–261
See application file for complete search history.

(56) References Cited

U.S. PATENT DOCUMENTS

| | | | | |
|---|---|---|---|---|
| 7,518,771 | B2 * | 4/2009 | Kurihara | 359/204.1 |
| 7,609,428 | B2 * | 10/2009 | Shiraishi | 359/204.5 |

FOREIGN PATENT DOCUMENTS

| | | |
|---|---|---|
| JP | 2006-091797 | 4/2006 |

* cited by examiner

*Primary Examiner* — Hai C Pham
(74) *Attorney, Agent, or Firm* — Wenderoth, Lind & Ponack, L.L.P.

(57) ABSTRACT

An angle formed between a first beam light ray D1 and a second beam light ray D2 is θ12, an angle formed between the second beam light ray D2 and a third beam light ray D3 is θ23, and an angle formed between the third beam light ray D3 and a fourth beam light ray D4 is θ34, where the first, second, third, and fourth beam light rays D1, D2, D3, and D4 have been reflected by a reflective surface of a rotating polygon mirror, θ23 is the smallest, of the three angles, that is, θ12, θ23, and θ34.

8 Claims, 5 Drawing Sheets

OPTICAL SCANNING APPARATUS AND IMAGE FORMING APPARATUS PROVIDED WITH THE SAME

CROSS-REFERENCE TO RELATED APPLICATION

This application is based upon and claims the benefit of priority from Japanese Patent Application No. 2013-226072 filed on Oct. 30, 2013, the entire contents of which are incorporated herein by reference.

BACKGROUND

Conventionally, as an electrophotographic full-color image forming apparatus, there is known a tandem machine provided with four photoreceptor drums corresponding to four colors, that is, yellow, cyan, magenta, and black. The image forming apparatus is configured such that after an electrostatic latent image on the photoreceptor drum is developed for each color with toner, a toner image in each color is sequentially superimposed on a paper to obtain a full color image. The image forming apparatus is provided with an optical scanning apparatus that scans a beam light ray on a circumferential surface of each photoreceptor drum.

As the optical scanning apparatus, there is known an optical scanning apparatus configured such that first to fourth beam light rays emitted from a light source unit enter the same reflective surface of a rotating polygon mirror, with a different incidence angle. In the optical scanning apparatus, the first to fourth beam light rays reflected by the rotating polygon mirror are reflected by first to fourth reflective mirrors, respectively, and guided to the circumferential surface of the four photoreceptor drums.

In the optical scanning apparatus of this type, it is proposed a technology in which as a reflection position by the reflective mirror is closer to the rotating polygon mirror, an angle formed between a beam light ray and a beam light ray adjacent thereto is set larger.

SUMMARY

An optical scanning apparatus according to one aspect of the present disclosure includes a light source unit, a rotating polygon mirror, an incident optical system, and first to fourth reflective mirrors. The light source unit emits first to fourth beam light rays scanned on first to fourth scanned surfaces. The rotating polygon mirror includes a plurality of reflective surfaces. The incident optical system allows the first to fourth beam light rays emitted from the light source unit to enter the same reflective surface of the rotating polygon mirror, with a different incidence angle. The first to fourth reflective mirrors reflect the first to fourth beam light rays having been reflected by the reflective surface, respectively, to guide these light rays to the first to fourth scanned surfaces.

The first to fourth beam light rays having been reflected by the reflective surface of the rotating polygon mirror are aligned in the order of the first beam light ray, the second beam light ray, the third beam light ray, and the fourth beam light ray, in a rotating axial-center direction of the rotating polygon mirror.

When a reflection position of the first beam light ray by the first reflective mirror is a first reflection position, a reflection position of the second beam light ray by the second reflective mirror is a second reflection position, a reflection position of the third beam light ray by the third reflective mirror is a third reflection position, and a reflection position of the fourth beam light ray by the fourth reflective mirror is a fourth reflection position, a distance from the rotating polygon mirror to each reflection position is set to become longer in the order of the first reflection position, the second reflection position, the third reflection position, and the fourth reflection position, in a direction orthogonal to an axial-center direction of the rotating polygon mirror.

An angle formed between the first beam light ray and the second beam light ray is θ12, an angle formed between the second beam light ray and the third beam light ray is θ23, and an angle formed between the third beam light ray and the fourth beam light ray is θ34, where the first, second, third, and fourth beam light rays have been reflected by the reflective surface of the rotating polygon mirror, θ23 is the smallest, of the three angles, that is, θ12, θ23, and θ34.

An image forming apparatus according to another aspect of the present disclosure includes the optical scanning apparatus.

DETAILED DESCRIPTION

Hereinafter, the present embodiment will be described in detail with reference to the drawings.

It is noted that the technology of the present disclosure is not limited to the following embodiments.

Embodiment

Figure 1:
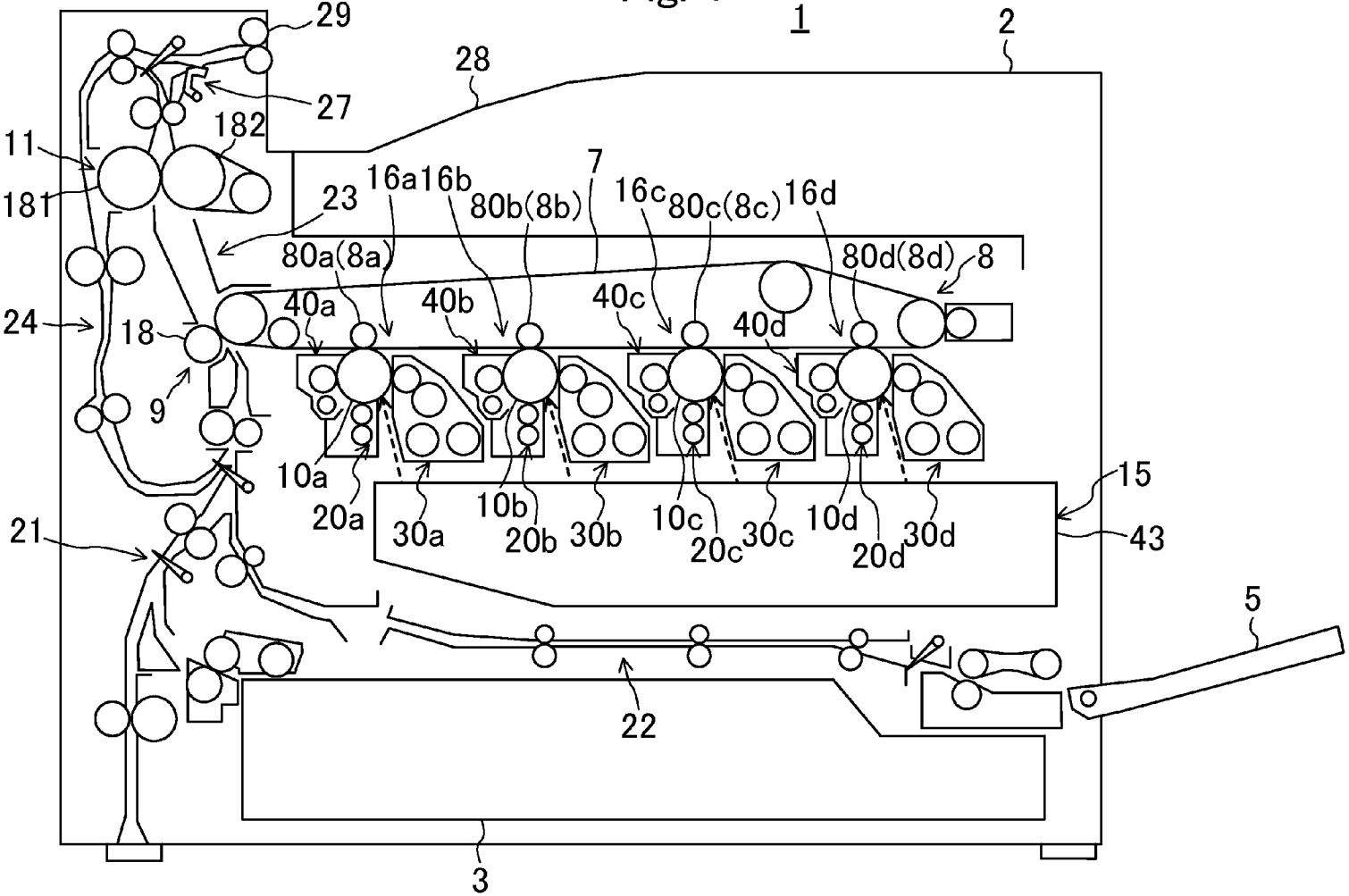
FIG. 1 is a schematic cross-sectional view showing an image forming apparatus provided with an optical scanning apparatus in an embodiment.

FIG. 1 shows an image forming apparatus 1 in a first embodiment.

The image forming apparatus 1 is a color printer of tandem type, and is provided with an intermediate transfer belt 7, a primary transfer unit 8 and a secondary transfer unit 9, a fixing unit 11, an optical scanning apparatus 15, four image forming units 16*a* to 16*d*, and first to fourth paper conveying units 21 to 24.

At an internal lower part of a body 2 of the image forming apparatus 1, a paper feed cassette 3 is placed.

The paper feed cassette 3 loads therein and houses a paper (not shown) such as a cut paper before being printed. The loaded papers are each separated and forwarded toward an upper left of the paper feed cassette 3 in FIG. 1.

The first paper conveying unit 21 is arranged at one side of the paper feed cassette 3. The first paper conveying unit 21 is placed along a left-side surface of the body 2. The first paper conveying unit 21 receives the paper forwarded from the paper feed cassette 3 and coveys the paper along the left-side surface of the body 2 to the secondary transfer unit 9 placed above.

At a right side of the paper feed cassette 3, a manual paper feed unit 5 is arranged. In the manual paper feed unit 5, a paper of size not yet prepared in the paper feed cassette 3, a thick paper, or an OHP sheet, for example, are loaded. At left of the manual paper feed unit 5, the second paper conveying unit 22 is arranged. The second paper conveying unit 22 extends substantially horizontally from the manual paper feed unit 5 to the first paper conveying unit 21 to merge with the first paper conveying unit 21. The second paper conveying unit 22 receives the paper, etc., forwarded from the manual paper feed unit 5 to convey the paper to the first paper conveying unit 21.

The optical scanning apparatus 15 is placed above the second paper conveying unit 22. In this case, the image forming apparatus 1 receives image data transmitted from outside. The image data is stored in a temporary storage unit (not shown), and thereafter, transmitted to the optical scanning apparatus 15, where appropriate. The optical scanning apparatus 15 irradiates the image forming units 16*a* to 16*d* with the laser light controlled on the basis of the image data.

The image forming units 16*a* to 16*d* are arranged above the optical scanning apparatus 15.

The image forming units 16*a* to 16*d* includes photoreceptor drums 10*a* to 10*d* respectively. In the photoreceptor drums 10*a* to 10*d*, charging units 20*a* to 20*d*, developing devices 30*a* to 30*d*, and cleaning devices 40*a* to 40*d* are respectively arranged. The cleaning devices 40*a* to 40*d* are arranged to clean a circumferential surface of the photoreceptor drums 10*a* to 10*d*.

Above each of the image forming units 16*a* to 16*d*, the endless intermediate transfer belt 7 is arranged. The intermediate transfer belt 7 is wound around a plurality of rollers and is configured to be rotationally driven by an unillustrated drive unit.

The four image forming units 16*a* to 16*d* are placed in one line along the intermediate transfer belt 7, as shown in FIG. 1, and form a toner image in yellow, magenta, cyan, or black, respectively. That is, in the image forming units 16*a* to 16*d*, the circumferential surface 10 of the photoreceptor drums 10*a* to 10*d* is respectively irradiated with the laser light by the optical scanning apparatus 15 to form an electrostatic latent image of an original document image, and the electrostatic latent image is developed by the developing devices 30*a* to 30*d* to form a toner image in each color.

Primary transfer units 8*a* to 8*d* are placed above the image forming units 16*a* to 16*d*, respectively. The primary transfer units 8*a* to 8*d* include primary transfer rollers 80*a* to 80*d* that primarily transfer the toner images formed by the image forming units 16*a* to 16*d* to the surface of the intermediate transfer belt 7. In the primary transfer rollers 80*a* to 80*d*, a transfer bias is applied by a transfer bias power source (not shown). The toner images of the image forming units 16*a* to 16*d* are respectively transferred, by the transfer bias applied to the primary transfer rollers 80*a* to 80*d*, to the intermediate transfer belt 7 at a predetermined timing. As a result, on the surface of the intermediate transfer belt 7, a color toner image in which the toner images in four colors, that is, yellow, magenta, cyan, and black, are superimposed is formed.

The secondary transfer unit 9 includes a secondary transfer roller 18 placed at a left side of the intermediate transfer belt 7. The secondary transfer roller 18 is applied a transfer bias by a transfer bias power source. The secondary transfer roller 18 sandwiches a paper P in between with the intermediate transfer belt 7. Thus, the toner image on the intermediate transfer belt 7 is to be transferred to the paper P by the transfer bias applied to the secondary transfer roller 18.

The fixing unit 11 is arranged above the secondary transfer unit 9. Between the secondary transfer unit 9 and the fixing unit 11, a third paper conveying unit 23 that conveys the paper P on which the toner image is secondarily transferred to the fixing unit 11 is formed.

The fixing unit 11 includes a heat roller 182 and a pressure roller 181, each of which rotates. The fixing unit 11 sandwiches the paper P by the heat roller 182 and the pressure roller 181 to heat and pressurize the toner image transferred to the paper P so that the toner image is fixed onto the paper P.

A branching unit 27 is arranged above the fixing unit 11. The paper P discharged from the fixing unit 11 is discharged from the branching unit 27 to a paper discharge unit 28 formed at an upper portion of the image forming apparatus 1, when a duplex printing is not performed. A discharge port portion through which the paper P is discharged from the branching unit 27 to the paper discharge unit 28 serves a function of a switch back unit 29. When the duplex printing is performed, at the switch back unit 29, the conveyance direction of the paper P discharged from the fixing unit 11 is switched.

—Details of Optical Scanning Apparatus—

Figure 2:
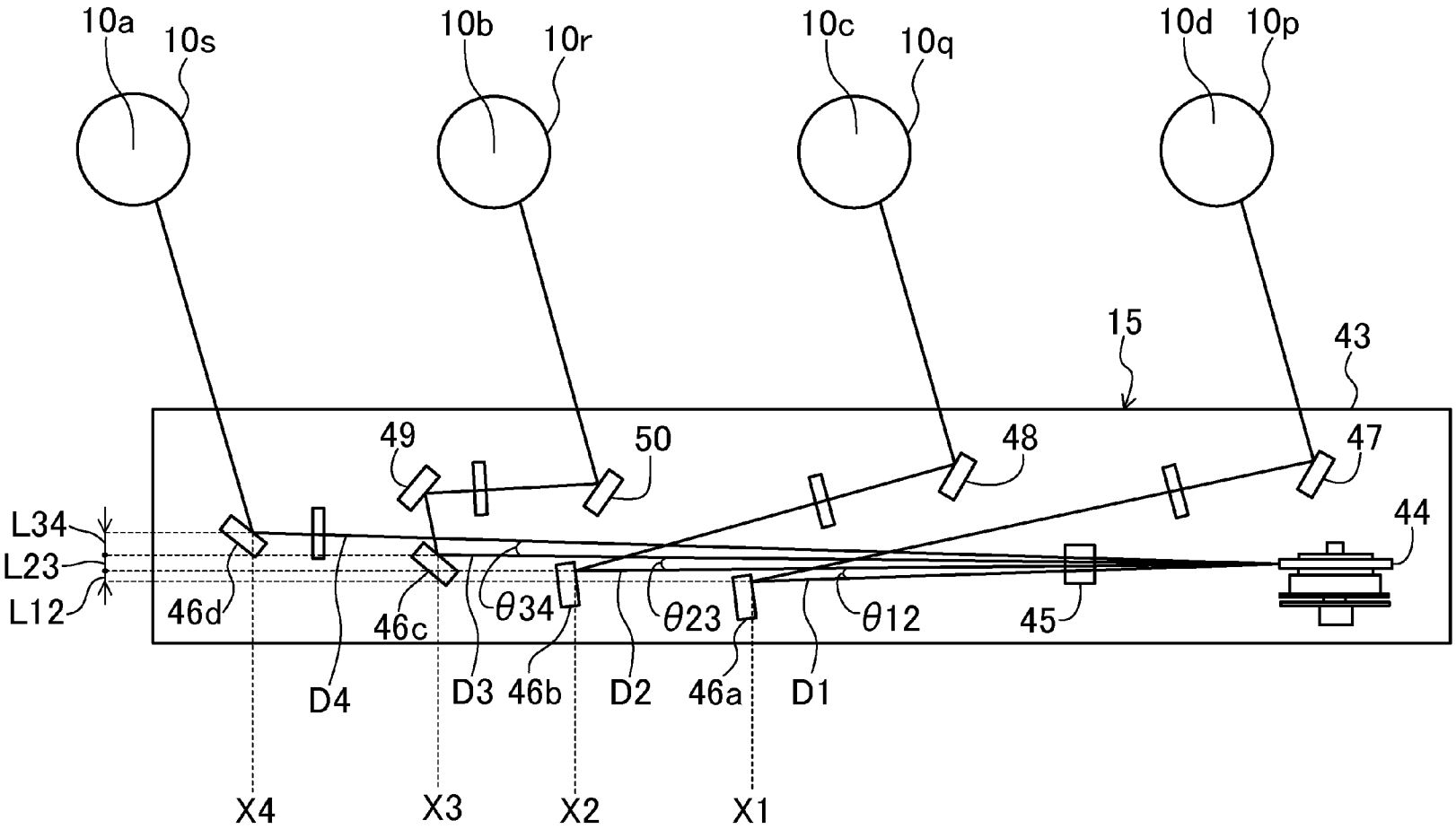
FIG. 2 is a schematic cross-sectional view showing an internal structure of an optical scanning apparatus.

As shown in FIG. 2, the optical scanning apparatus 15 includes a housing 43.

Inside the housing 43, a polygon mirror (rotating polygon mirror) 44 is placed.

In the present embodiment, the polygon mirror 44 is of regular hexagonal shape having six reflective surfaces 44*a* at its side surfaces, and is rotated at a predetermined speed by a motor (not shown).

Figure 3:
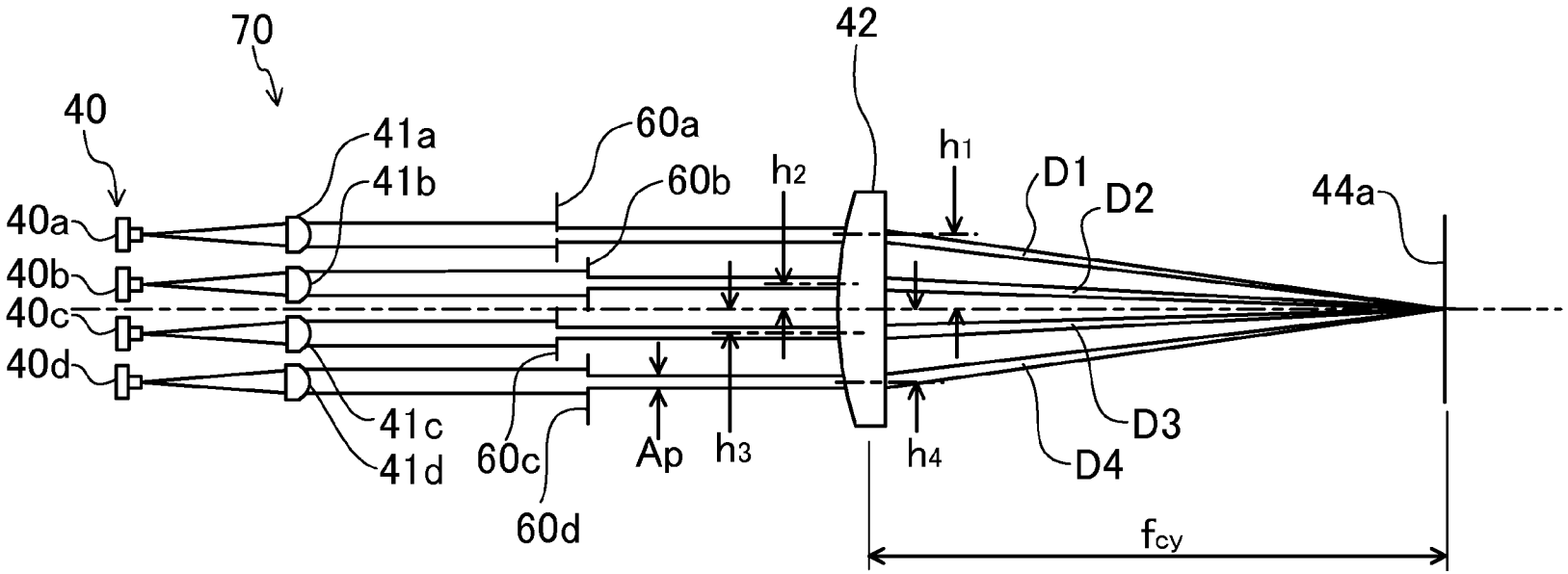
FIG. 3 is a schematic diagram linearly showing an incident optical system from a light source of an optical scanning apparatus to a reflective surface of a polygon mirror.

FIG. 3 is a schematic diagram linearly showing an incident optical system 70 from a light source unit 40 of the optical scanning apparatus 15 to the reflective surfaces 44*a* of the polygon mirror 44.

The light source unit 40 includes four light sources 40*a*, 40*b*, 40*c*, and 40*d*.

The four light sources 40*a* to 40*d* are placed with an interval in a sub scanning direction (rotating axial-center direction of the polygon mirror 44, or a vertical direction of the FIG. 3). The light sources 40*a* to 40*d* are configured by a laser diode, and emits beam light rays (laser light beams) D1 to D4 optically modulated on the basis of an image signal. Between the light sources 40*a* to 40*d* and the polygon mirror 44, four collimator lenses 41*a* to 41*d* arranged to correspond to the respective light sources 40*a* to 40*d*, apertures 60*a* to 60*d* that render the beam light rays D1 to D4 passing through the collimator lenses 41*a* to 41*d* a predetermined optical path width, and a cylinder lens 42 through which the beam light rays D1 to D4 having passing through the apertures 60*a* to 60*d* respectively pass, are placed.

The collimator lenses 41*a* to 41*d* render the beam light rays D1 to D4 output from the light sources 40*a* to 40*d* a substantially parallel luminous flux, and the cylinder lens 42 includes a predetermined refractive power in the sub scanning direction only. Returning to FIG. 2, on an optical path of each of the beam light rays D1 to D4 from the polygon mirror 44 to the photoreceptor drums 10*a* to 10*d*, an fθ lens 45, first to fourth reflective mirrors 46*a* to 46*d*, and mirrors 47 to 50 are placed.

A scanning operation of the beam light rays D1 to D4 by the optical scanning apparatus 15 thus configured will be described. Firstly, the beam light rays D1 to D4 output respectively from the light source units 40*a* to 40*d* are converted into a substantially parallel luminous flux by the collimator lens 41*a* to 41*c*, and converted into a predetermined optical path width by the apertures 60*a* to 60*d*. Next, the beam light rays D1 to D4 converted into a substantially parallel luminous flux are incident on the cylinder lens 42. The beam light rays D1 to D4 incident on the cylinder lens 42, while keeping a parallel luminous flux in a main scanning cross section (cross section where the sub scanning direction is a normal line), is converged to be output in a sub scanning cross section (cross section where the main scanning direction is a normal line), and is focused, as a linear image, on the reflective surfaces 44*a* of the polygon mirror 44. At this time, to facilitate optical path separation of the four beam light rays D1 to D4 deflected by the polygon mirror 44, as seen from the sub scanning cross section (see FIG. 3), the beam light rays D1 to D4 enter the reflective surfaces 44*a* with a respectively different angle.

The beam light rays D1 to D4 incident on the polygon mirror 44 is scanned by the polygon mirror 44 at a constant angular velocity, and then, is converted into a scanning at a constant velocity by the fθ lens 45. The beam light rays D1 to D4 passing through the fθ lens 45 is respectively reflected by the first to fourth reflective mirrors 46*a* to 46*d*, and then, guided to surfaces 10*p* to 10*s* of the photoreceptor drums 10*a* to 10*d* to be scanned. Specifically, the first beam light ray D1 is reflected by the first reflective mirror 46*a*, and then, reflected by the mirror 47, and enters, with irradiation, the surface 10*p* (first scanned surface) of the photoreceptor drum 10*d*. The second beam light ray D2 is reflected by the second reflective mirror 46*b*, and then, reflected by the mirror 48, and enters, with irradiation, the surface 10*q* (second scanned surface) of the photoreceptor drum 10*c*.

The third beam light ray D3 is reflected by the third reflective mirror 46*c*, and then, reflected by the mirror 49 and the mirror 50, and enters, with irradiation, the surface 10*r* (third scanned surface) of the photoreceptor drum 10*b*. The fourth beam light ray D4 is reflected by the fourth reflective mirror 46 and enters, with irradiation, the surface 10*s* (fourth scanned surface) of the photoreceptor drum 10*a*.

The first to fourth beam light rays D1 to D4 having been reflected by the reflective surfaces 44*a* of the polygon mirror 44 are aligned in the order of the first beam light ray D1, the second beam light ray D2, the third beam light ray D3, and the fourth beam light ray D4, in the rotating axial-center direction of the polygon mirror 44.

When a reflection position of the first beam light ray D1 by the first reflective mirror 46*a* is a first reflection position X1, a reflection position of the second beam light ray D2 by the second reflective mirror 46*b* is a second reflection position X2, a reflection position of the third beam light ray D3 by the third reflective mirror 46*c* is a third reflection position X3, and a reflection position of the fourth beam light ray D4 by the fourth reflective mirror 46*d* is a fourth reflection position X4, a distance from the polygon mirror 44 to each of the reflection positions X1 to X4 is set to become longer in the order of the first reflection position X1, the second reflection position X2, the third reflection position X3, and the fourth reflection position X4, in a direction orthogonal to an axial-center direction of the polygon mirror 44 (radial direction of the polygon mirror 44, or a left-to-right direction in FIG. 2).

That is, a relationship of X1<X2<X3<X4 is satisfied.

Incidentally, in the conventional image forming apparatus, as the reflection position of a beam light ray by the reflective mirrors 46*a* to 46*d* are closer to the polygon mirror 44, an angle formed between the beam light ray and a beam light ray adjacent thereto is set to be larger. That is, in the conventional image forming apparatus, when an angle formed between the first and the second beam light rays D1 and D2 is θ12, an angle formed between the second and the third beam light rays D2 and D3 is θ23, and an angle formed between the third and fourth beam light rays D3 and D4 is θ34, a relationship of θ12>θ23>θ34 is satisfied. Such an angle setting is intended to prevent interference between the reflective mirrors 46*a* to 46*d* and the beam light ray adjacent to a beam light ray to be incident on each reflective mirror, and is based on an ordinary idea of a person skilled in the art that "if the incidence angle of the beam light rays D1 to D4 incident on the reflective surfaces 44*a* of the polygon mirror 44 were the same angle among each of the beam light rays D1 to D4, an interval between the adjacent beam light rays is narrower as it comes nearer the polygon mirror 44".

However, in this case, there is a problem that the angles formed between the adjacent beam light rays (that is, θ12, θ23, and θ34) are accumulated to make an entire incidence angle of the beam light rays D1 to D4 larger, accordingly increasing a whole of the image forming apparatus 1 in size.

On the other hand, the inventors of the present application made an extensive study to discover that when θ23 is minimized out of θ12, θ23, and θ34, it is possible to restrain the entire incidence angle of the beam light rays D1 to D4 while preventing the interference between the reflective mirror 46 and the beam light ray adjacent thereto.

This point will be specifically described below.

The interval in a sub scanning direction of the beam light ray at the reflection positions X1, X2, and X3 is evaluated according to the following equations (1) to (3).

(1) Interval between beam light rays at the reflection position $X1$ = (height at center portion of image height of first beam light ray at reflection position $X1$) − (height at end portion of image height of second beam light ray at reflection position $X1$) = ((height of at center portion of image height of first beam light ray at reflection position $X1$) − (beam width at center portion of height image of second beam light ray at reflection position $X1/2 \times \text{margin}$)) − ((height at end portion of image height of second beam light ray at reflection position $X2$) + (beam width at end portion of image height of second beam light ray at reflection position $X2/2 \times \text{margin}$)) =

$$(d_{1-2} \times h1/f_{cy} - d_{1-2} \times (Ap/2/f_{cy}) \times \alpha) - (d_{1-2} \times h_2/f_{cy}/\cos\theta + d_{1-2} \times (Ap/2/f_{cy}) \times \alpha/\cos\theta) = d_{1-2} \times (h_1 - Ap \times \alpha/2 - (h_2 + Ap \times \alpha/2)/\cos\theta)/f_{cy}$$

(2) Interval between beam light rays at the reflection position $X2$ = (height at center portion of image height of second beam light ray at reflection position $X2$) − (height at center portion of image height of third beam light ray at reflection position $X2$) =

$$d_{2-3} \times (h_2 - h_3 - Ap \times \alpha)/f_{cy}$$

(3) Interval between beam light rays at the reflection position $X3$ = (height at end portion of image height of third beam light ray at reflection position $X3$) − (height at center portion of image height of fourth beam light ray) =

$$d_{3-4} \times ((h_3 - Ap \times \alpha/2)/\cos\theta - h_4 + Ap \times \alpha/2)/f_{cy}$$

In this case:

$f_{f\theta}$: focal length of a lens

θ: angle in a main scanning cross section of a light ray moving toward image-height end portion $f_{cy}$: focal length of a cylinder lens $h_1$: incidence height of a first beam light ray to a cylinder lens $h_2$: incidence height of a second beam light ray to a cylinder lens $h_3$: incidence height of a third beam light ray to a cylinder lens $h_4$: incidence height of a fourth beam light ray to a cylinder lens Ap: aperture diameter α: margin of a beam light ray diameter $d_{1-2}$: distance between a reflective surface of a polygon mirror and a reflection position X1

$d_{2-3}$: distance between a reflective surface of a polygon mirror and a reflection position X2

$d_{3-4}$: distance between a reflective surface of a polygon mirror and a reflection position X3

According to the above (1) to (3), if the incidence angle of the beam light rays D1 to D4 to the reflective surfaces 44*a* of the polygon mirror 44 is set to be the same among each of the beam light rays D1 to D4 (angle formed between each of the adjacent beam light rays D1 to D4 incident on the reflective surfaces 44*a* is set to be the same), then it is understood that an interval (that is, a clearance in a sub scanning direction between the second beam light ray D2 and the third beam light ray D3 at the reflection position X2) in a sub scanning direction of the beam light ray at the reflection position X2 (rotation axis direction of the polygon mirror 44) is the widest.

A specific calculation example is shown below.

For example, when $f_{f\theta}$=300 mm, θ=0.5 rad)(28.65°, $f_{cy}$=90 mm, $h_1$=5.1 mm, $h_2$=1.7 mm, $h_3$=−1.7 mm, $h_4$=−5.1 mm, Ap=1 mm, α=2, $d_{1-2}$=180 mm, $d_{2-3}$=140 mm, and $d_{3-4}$=90 mm, the interval between the beam light rays at each of the reflection positions X1 to X3 is as follows:

the interval between the first beam light ray D1 and the second beam light ray D2 at the reflection position X1 is 2.05 mm;

the interval between the second beam light ray D2 and the third beam light ray D3 at the reflection position X2 is 2.18 mm; and the interval between the third beam light ray D3 and the fourth beam light ray D4 at the reflection position X3 is 1.02 mm.

According thereto, it is known that the interval between the second and third beam light rays D2 and D3 is the widest (that is, has the largest margin in terms of space), which is followed by the interval between the first and second beam light rays D1 and D2, and the interval between the third and fourth beam light rays D3 and D4 is the narrowest.

Figure 4:
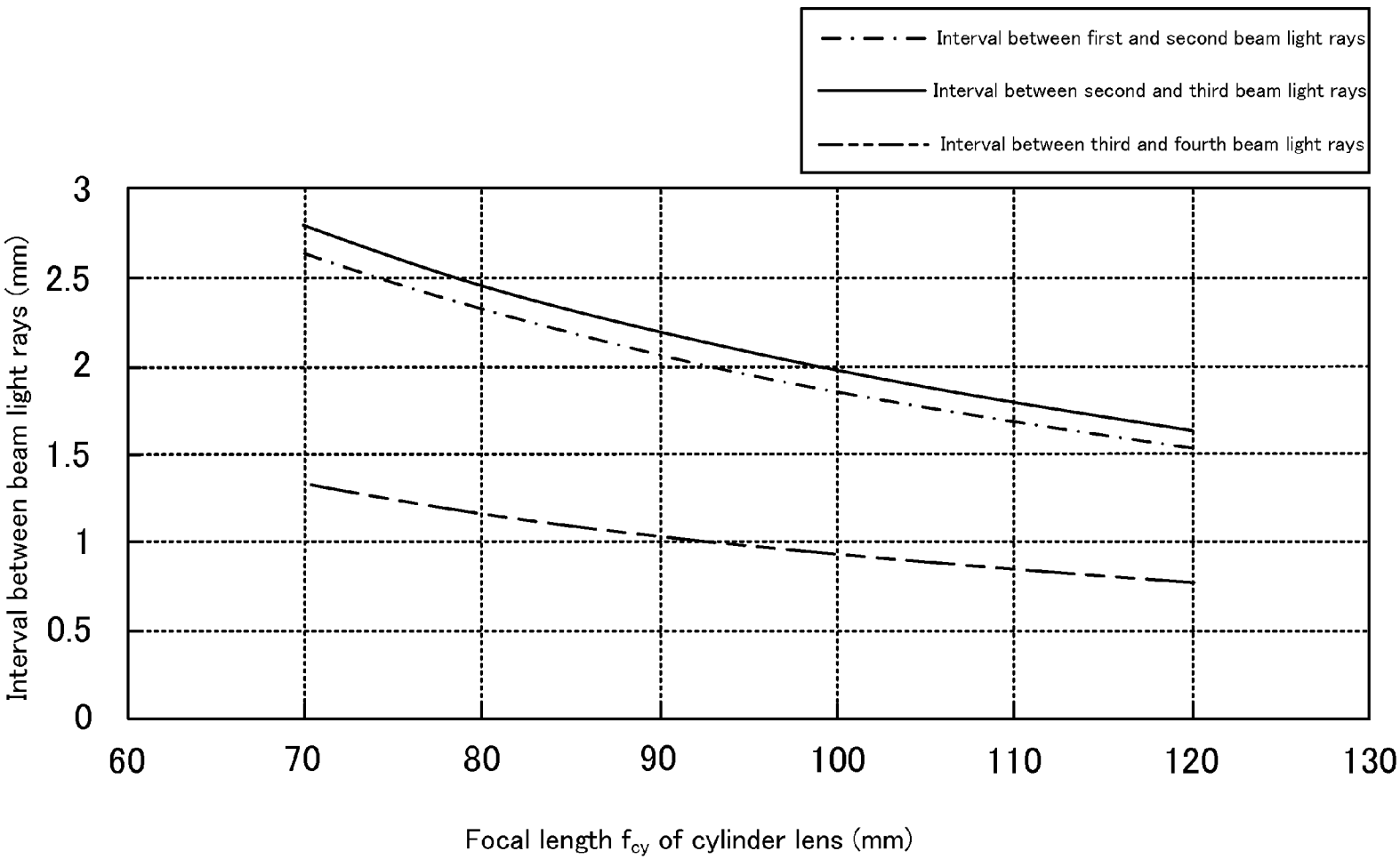
FIG. 4 is a graph showing an interval between beam light rays when a focal length of a cylinder lens is changed.
Figure 5:
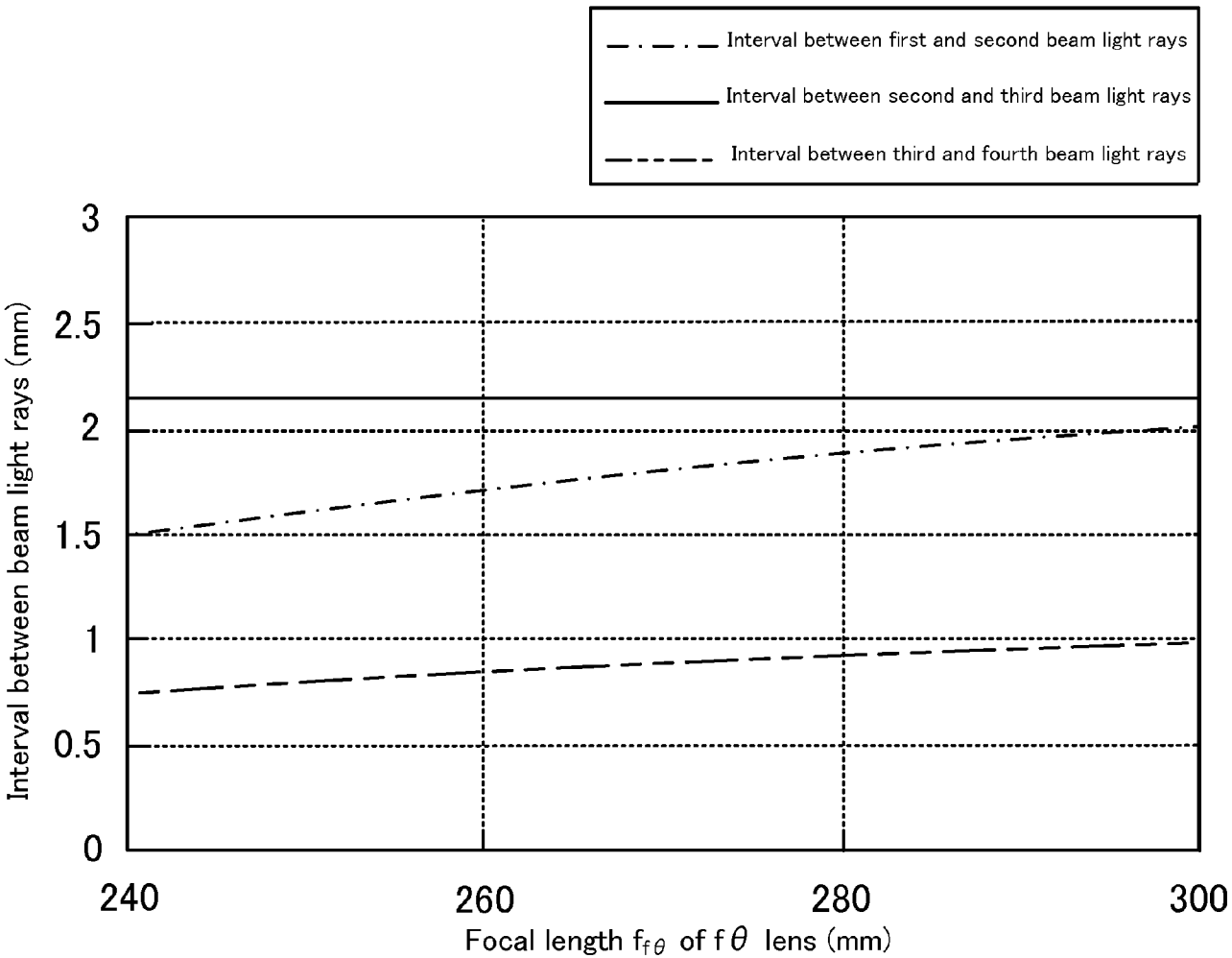
FIG. 5 is a graph showing an interval between beam light rays when a focal length of an fθ lens is changed.

FIG. 4 is a graph showing a result obtained by calculating the interval between each of the beam light rays when the focal length $f_{cy}$ of the cylinder lens is changed. FIG. 5 is a graph showing a result obtained by calculating the interval between each of the beam light rays when the focal length of the fθ lens is changed.

It is known also from these graphs that the interval between the second and third beam light rays D2 and D3 is the widest and the interval between the third and fourth beam light rays D3 and D4 is the narrowest.

The inventors took notice of this, and reached to an angle setting in which the angle θ23 formed between the second and third beam light rays D2 and D3, which has the largest margin in terms of space, was set to be smallest, the angle θ34 formed between the third and fourth beam light rays D3 and D4, which has the smallest margin in terms of space, was set to be largest, and the angle θ12 formed between the first and second beam light rays D1 and D2 was set to be larger than θ23 and to be smaller than θ34.

That is, in the present embodiment, a relationship of θ34>θ12>θ23 is satisfied. As a result, it is possible to restrain the entire incidence angle of the beam light rays while preventing the interference between the reflective mirror 46 and the beam light ray adjacent thereto.

EXAMPLE

Next, an example in which the structure according to the embodiment is adopted will be described.

Various dimension values are equal to the following dimension values used for calculation in the above-described embodiment.

$f_{f\theta}$=300 mm,θ=0.5rad)(28.65°),$f_{cy}$=90 mm,

Ap=1 mm, α=2, $d_{1-2}$=180 mm, $d_{2-3}$=140 mm, and $d_{3-4}$=90 mm

In this case, the interval between the beam light rays at each of the reflection positions X1 to X4 needs to be about 1 mm, for example, to avoid the interference between the light ray and the reflective mirror 46.

However, when the interval between the beam light rays is equal to or more than 2 mm, the entire apparatus becomes too large.

To resolve this, on the basis of the above-described equations (1) to (3), an incidence height of each of the beam light rays D1 to D4 to the cylinder lens 42 so that the interval between each of the beam light rays D1 to D4 is about 1 mm was calculated backward.

Then, when $h_1$=4.5 mm, $h_2$=1.6 mm, $h_3$=−1.15 mm, and $h_4$=−4.5 mm, an interval L12 between the first and second beam light rays D1 and D2 was 1.07 mm, an interval L23 between the second and third beam light rays D2 and D3 was 1.17 mm, and an interval L34 between the third and fourth beam light rays D3 and D4 was 1.05 mm. The above-described intervals L12, L23, and L34 are 1 mm or more and 2 mm or less. The above-described intervals L12, L23, and L34 stay within a range of +/−10% on the basis of an average value (1.10 mm) of the three intervals L12, L23, and L34. It can be said that the three intervals L12, L23, and L34 are set to be substantially equal in length.

The angle formed at this time between each of the beam light rays D1 to D4 was as follows: θ12=1.85° (=tan−1 ((4.5−1.6)/90)), θ23=1.75° (=tan−1 ((1.6−(−1.15))/90)), θ34=2.13° (=tan−1 ((−1.15−(−4.5))/90)).

According to the optical scanning apparatus 15 in the present embodiment, when such an angle setting was performed, it was possible to restrain the entire incidence angle of the beam light rays while preventing the interference between the reflective mirror 46 and the beam light ray adjacent thereto.

As described above, the technology of the present disclosure is useful for an optical scanning apparatus and an image forming apparatus provided with the optical scanning apparatus, and is particularly useful when the technology is applied to a laser printer, a copier, a scanner, and a multifunction peripheral, for example.

What is claimed is:

1. An optical scanning apparatus, comprising:

a light source unit that emits first to fourth beam light rays scanned on first to fourth scanned surfaces;

a rotating polygon mirror having a plurality of reflective surfaces; and an incident optical system with which the first to fourth beam light rays emitted from the light source unit are applied to a same reflective surface of the rotating polygon mirror, with different incidence angles, and first to fourth reflective mirrors that reflect respectively the first to fourth beam light rays having been reflected by the reflective surface to guide these light rays to the first to fourth scanned surfaces, wherein the first to fourth beam light rays having been reflected by the reflective surface of the rotating polygon mirror are aligned in the order of the first beam light ray, the second beam light ray, the third beam light ray, and the fourth beam light ray, in a rotating axial-center direction of the rotating polygon mirror, when a reflection position of the first beam light ray by the first reflective mirror is a first reflection position, a reflection position of the second beam light ray by the second reflective mirror is a second reflection position, a reflection position of the third beam light ray by the third reflective mirror is a third reflection position, and a reflection position of the fourth beam light ray by the fourth reflective mirror is a fourth reflection position, a distance from the rotating polygon mirror to each reflection position is set to become longer in the order of the first reflection position, the second reflection position, the third reflection position, and the fourth reflection position, in a direction orthogonal to an axial-center direction of the rotating polygon mirror, when an angle formed between the first beam light ray and the second beam light ray is θ12, an angle formed between the second beam light ray and the third beam light ray is θ23, and an angle formed between the third beam light ray and the fourth beam light ray is θ34, where the first, second, third, and fourth beam light rays having been reflected by the reflective surface of the rotating polygon mirror, θ23 is the smallest, of the three angles, that is, θ12, θ23, and θ34, and an interval L12 in a sub scanning direction between the first beam light ray and the second beam light ray at a reflection position by the first reflective mirror, an interval L23 in a sub scanning direction between the second beam light ray and the third beam light ray at a reflection position by the second reflective mirror, and an interval L34 in a sub scanning direction between the third beam light ray and the fourth beam light ray at a reflection position by the third reflective mirror are each set to be within a range of size of +/−10% on the basis of an average value of the three intervals L12, L23, and L34.

2. The optical scanning apparatus according to claim 1, wherein the interval L12, the interval L23, and the interval L34 are all 1 mm or more and 2 mm or less.

3. The optical scanning apparatus according to claim 2, wherein a relationship of θ34>θ12>θ23 is satisfied.

4. An image forming apparatus comprising the optical scanning apparatus according to claim 3.

5. An image forming apparatus comprising the optical scanning apparatus according to claim 2.

6. The optical scanning apparatus according to claim 1, wherein a relationship of θ34>θ12>θ23 is satisfied.

7. An image forming apparatus comprising the optical scanning apparatus according to claim 6.

8. An image forming apparatus comprising the optical scanning apparatus according to claim 1.

* * * * *